US005964359A

United States Patent [19]

Marino, Jr.

[11] Patent Number: 5,964,359

[45] Date of Patent: Oct. 12, 1999

[54] MODULAR STORAGE SYSTEM

[76] Inventor: Frank A. Marino, Jr., 1541 S. Hillock Ter., Inverness, Fla. 34452

[21] Appl. No.: 08/905,556

[22] Filed: Aug. 4, 1997

[51] Int. Cl.[6] ..... A47B 73/00; A47F 7/02

[52] U.S. Cl. ..... 211/74; 211/75; 211/85.29; 248/312

[58] Field of Search ..... 211/74, 75, 85.29, 211/94.01, 94.02, 76, 77; 248/312.1, 312

[56] References Cited

U.S. PATENT DOCUMENTS

| | | | |
|---|---|---|---|
| D. 207,411 | 4/1967 | Diesinger, Jr. . | |
| 278,161 | 5/1883 | McKee | 211/162 X |
| 1,206,660 | 11/1916 | Boisseau | 248/312 X |
| 1,761,218 | 6/1930 | Lundy et al. . | |
| 1,958,781 | 5/1934 | Beukema | 211/74 X |
| 2,051,481 | 8/1936 | Hudson | 211/74 X |
| 2,057,946 | 10/1936 | Harris | 211/75 X |
| 2,508,945 | 5/1950 | Heuer . | |
| 2,619,310 | 11/1952 | Winslow | 248/312 X |
| 2,633,323 | 3/1953 | Burger . | |
| 2,757,804 | 8/1956 | Sadwin | 211/94.01 |
| 2,816,667 | 12/1957 | Tanay . | |
| 3,198,143 | 8/1965 | Biglieri | 211/76 X |
| 3,224,594 | 12/1965 | Schweitzer . | |
| 3,300,075 | 1/1967 | Dahl . | |
| 3,365,068 | 1/1968 | Crosby . | |
| 3,527,345 | 9/1970 | Iorio | 211/74 X |
| 4,019,638 | 4/1977 | Miller | 211/74 |
| 5,542,561 | 8/1996 | Slink et al. | 220/291 |
| 5,755,341 | 5/1998 | Spamer | 211/74 X |

*Primary Examiner*—Daniel P. Stodola
*Assistant Examiner*—Erica B. Harris
*Attorney, Agent, or Firm*—Wood, Phillips, VanSanten, Clark & Mortimer

[57] ABSTRACT

A modular storage system is adapted for mounting to a support surface such as a wall or the underside of a cabinet. The system comprises a base including a planar top wall connected to opposite downwardly depending side walls and a bottom wall extending between the side walls. The bottom wall has a front opening cutout. The top, bottom and side walls together define a front facing channel contiguous with the cutout. A cover includes a body of a size smaller than the channel, yet larger than the cutout and a downwardly opening threaded collar affixed to the body for threadably mounting a storage jar. The cover is removably receivable in the channel with the collar positioned above the cutout. The body bears on the bottom wall with a jar mounted to the collar extending downwardly through the cutout.

16 Claims, 3 Drawing Sheets

MODULAR STORAGE SYSTEM

FIELD OF THE INVENTION

This invention relates to storage systems and, more particularly, to a modular storage system.

BACKGROUND OF THE INVENTION

With any storage system it is advantageous to make maximum use of available space. A typical storage requirement is for small parts around the house. Rather than storing the parts loose in drawers and the like, it has been known to store small parts in jars or cans. Doing so requires shelf or counter space to accommodate the jars or cans. For example, in the past hardware parts have often been stored in glass storage jars obtained from food products such as baby food, jelly, peanut butter, etc. An individual would often nail the used jar lids to a wood board shelf. The glass storage jar containing the parts is then screwed into the lid. However, this required proper alignment of the jar for mounting, and appropriate gripping while removing the jar to avoid breakage. If the lid is not tightly secured to the shelf, then turning of the jar could cause corresponding turning of the lid so that the jar could not be installed or removed without using the other hand to hold the lid. This renders such a system much more difficult to use.

The present invention is directed to overcoming one or more of the problems discussed above in a novel and simple manner.

SUMMARY OF THE INVENTION

In accordance with the invention there is provided a modular storage system including a base and removably receivable cover.

Broadly, there is disclosed herein a modular storage system adapted for mounting to a support surface. The system comprises a base including a planar top wall connected to opposite downwardly depending side walls and a bottom wall extending between the side walls. The bottom wall has a front opening cutout. The top, bottom and side walls together define a front facing channel contiguous with the cutout. A cover includes a body of a size smaller than the channel, yet larger than the cutout and a downwardly opening threaded collar affixed to the body for threadably mounting a storage jar. The cover is removably receivable in the channel with the collar positioned above the cutout. The body bears on the bottom wall with a jar mounted to the collar extending downwardly through the cutout.

It is a feature of the invention that the base comprises a plastic base.

It is another feature of the invention that the base is an integral one-piece unit.

It is a further feature of the invention that the base includes openings through the top wall for receiving fasteners to secure the base to a horizontal support surface.

It is an additional feature of the invention to provide brackets mounted to the base with the fasteners, the brackets adapting the base for mounting to a vertical support surface.

It is an additional feature of the invention that the cover body is rectangular configuration corresponding to configuration of the channel.

It is yet another feature of the invention that the cover comprises a plastic cover.

It is still a further feature of the invention that the cover is an integral one-piece unit.

There is disclosed herein in accordance with an alternative embodiment of the invention a modular storage system adapted for mounting to a support surface. The system comprises a base including an elongate planar top wall connected to a plurality of parallel, longitudinally spaced downwardly depending side walls. A bottom wall is parallel to the top wall and connected to bottoms of the side walls. The bottom wall has a front opening cutout between each pair of adjacent side walls. The top, bottom, and side walls together define a plurality of front facing channels, each contiguous with one of the cutouts. A plurality of covers are included. Each cover includes a body of a size smaller than each channel, yet larger than each cutout and a downwardly opening threaded collar affixed to the body for threadably mounting a storage jar. Each cover is removably receivable in one of the channels with its collar positioned above the associated cutout. The body bears on the bottom wall with a jar mounted to the collar extending downwardly through the associated cutout.

Further features and advantages of the invention will be readily apparent from the specification and from the drawings.

DETAILED DESCRIPTION OF THE INVENTION

Figure 1:
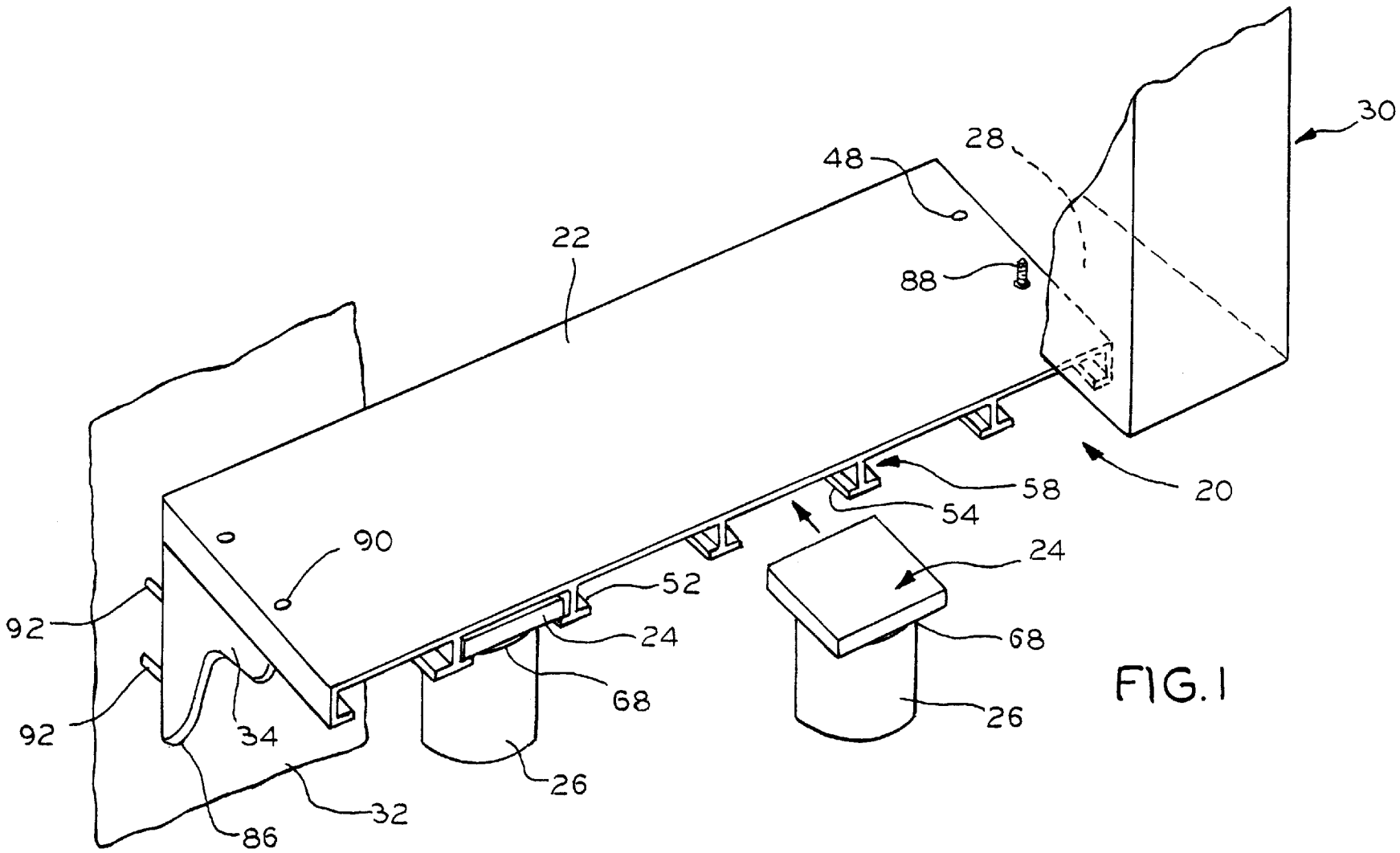
FIG. 1 is a perspective view of a modular storage system according to the invention specifically illustrating two different mounting options for the storage system.

Referring initially to FIG. 1, a modular storage system 20 according to the invention is illustrated. The storage system consists essentially of a storage shelf or base 22 and one or more rectangular lids or covers 24. The covers are used with jars 26 which are screwed into the lids 24. The lids 24 slide into the storage shelf 22 as described more particularly below.

As will be apparent, the storage system may be adapted for use with any type of jar 26. The storage system 20 may be provided without jars 26. A user could then use old jars, such as baby food jars, jelly or peanut butter jars or the like for holding parts to be stored. These used jars would be screwed into the covers 24.

The storage system 20 is adapted for mounting to various different support surfaces. For example, the system 20 can be mounted to a horizontal support surface such as the underside 28 of a cabinet 30. Alternatively, the storage system 20 can be mounted to a vertical support surface such as a wall 32 using optional brackets 34.

Figure 2:
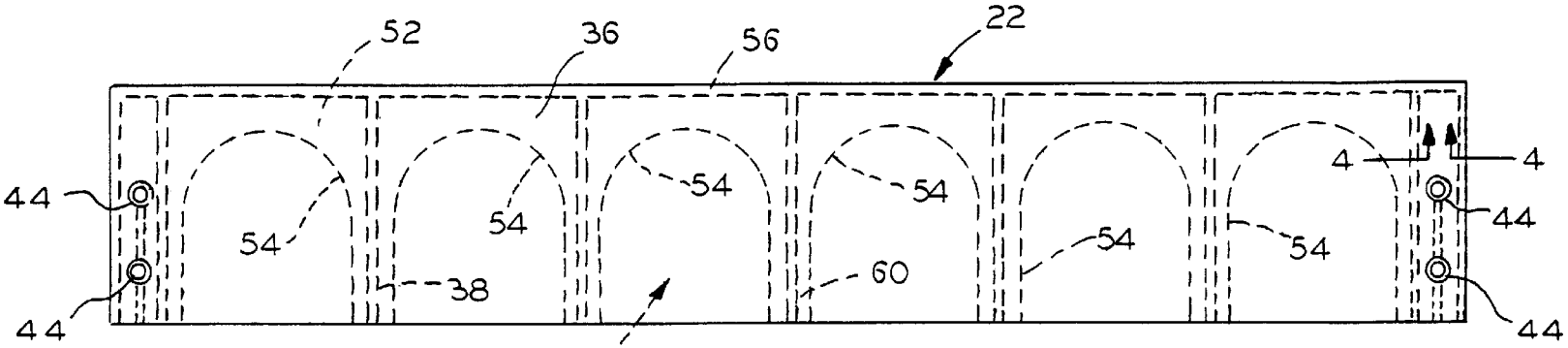
FIG. 2 is a top view of a base of the storage system of FIG. 1.
Figure 3:
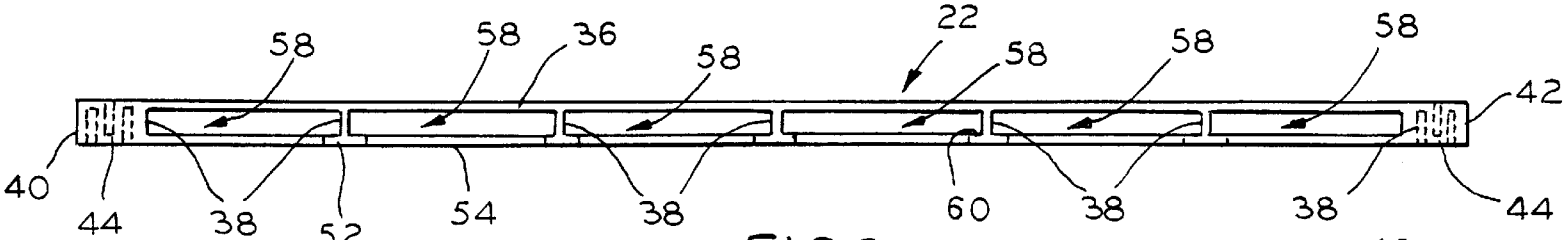
FIG. 3 is a front view of the base of FIG. 2.
Figure 4:
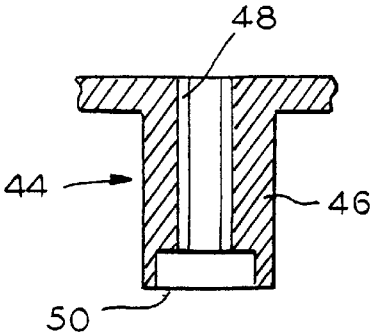
FIG. 4 is a sectional view taken along the line 4—4 of FIG. 2.

Referring to FIGS. 2–4, the base 22 is illustrated in detail. The base 22 includes an elongate, rectangular planar top wall 36. The length and width are selected according to the size and number of jars to be stored. In the illustrated embodiment of the invention, the top wall 36 is approximately twenty-seven inches long and 4 ½ inches wide. A plurality of parallel, longitudinally spaced side walls 38 are connected to and depend downwardly from the top wall 36. In the illustrated embodiment adjacent pairs of side walls 38 are equally spaced apart. The illustrated embodiment includes seven such side walls. Also included are opposite end side walls 40 and 42 spaced apart from the outermost of the side walls 38 by shorter distances. Disposed longitudinally inwardly of each end wall 40 and 42 are a pair of downwardly depending bosses 44. The bosses are particularly illustrated in FIG. 4 and comprise a tubular body 46 including a through opening 48 and a downwardly opening counterbore 50. The through opening 48 is adapted to receive a fastener, such as a screw, with the head of the fastener being received in the counterbore 50 for suitably mounting the base 22.

A bottom wall 52 is parallel to the top wall and connected to bottoms of the side walls 38. The bottom wall 52 is of a width corresponding to the width of the top wall 36. The bottom wall 52 is of a shorter length, as it only extends between the outermost of the sidewalls 38. That is, the bottom wall 52 does not connect to the end side walls 40 and 42. The bottom wall 52 has a front opening cutout 54 between each pair of adjacent side walls 38. The cutout 54 is generally U-shaped. A rear wall 56 is connected to the top wall 36, the bottom wall 52, and the side walls 38, 40 and 42, at a rearmost edge of each.

The top wall 36, bottom wall 52, and adjacent pairs of side walls 38 together define a plurality of front facing channels 58. Each channel 58 is contiguous with one of the cutouts 54. Each channel 58 is of generally rectangular configuration, with the size corresponding to the size of a cover 24 to be used therewith.

In the illustrated embodiment of the invention, each channel 58 is approximately 4.5 inches wide defined by spacing between adjacent side walls 38. The cutout 54 at the front edge is between 3.25 inches and 3.50 inches. The height of the channel 58 is approximately 0.50 inch. Owing to this configuration, the bottom wall 52 provides a bearing surface 60 surrounding each cutout 54 within each channel 58.

In accordance with the invention, the base 22 is an injected molded plastic part and is an integral one-piece unit.

Figure 5:
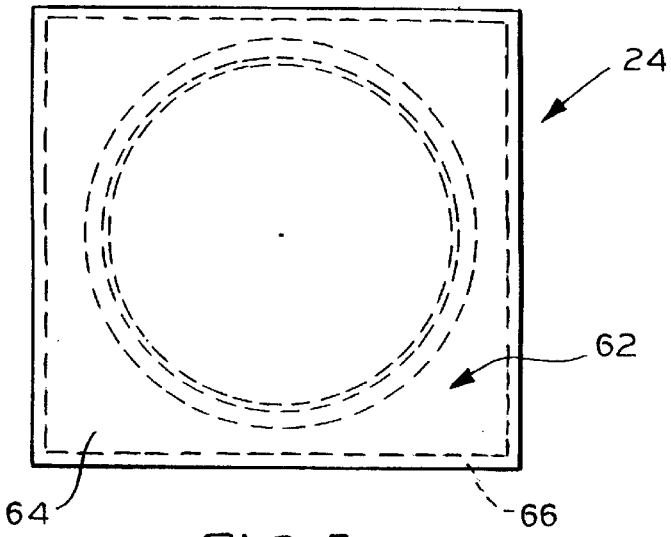
FIG. 5 is a top view of a cover of the storage system of FIG. 1.
Figure 8:
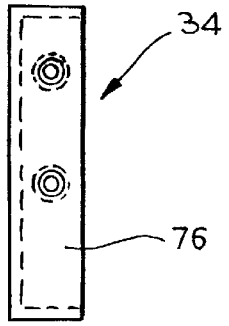
FIG. 8 is a top view of the bracket of FIG. 7.
Figure 6:
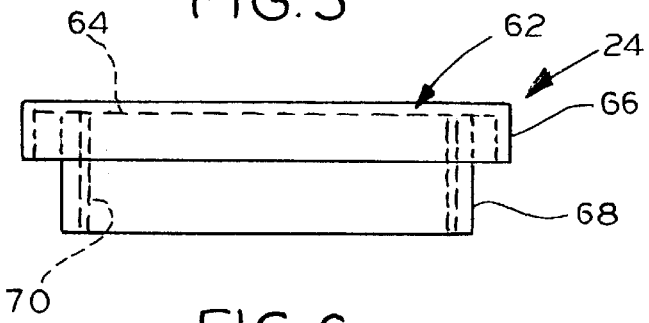
FIG. 6 is a side view of the cover of FIG. 5.
Figure 9:
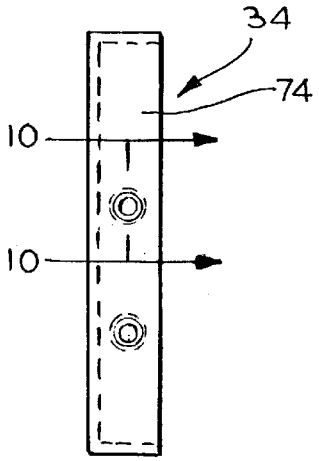
FIG. 9 is a rear view of the bracket of FIG. 7.
Figure 7:
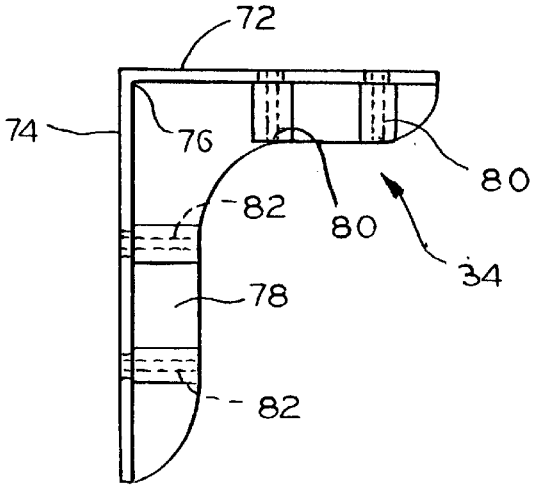
FIG. 7 is a side view of a bracket of the storage system of FIG. 1.

Referring to FIGS. 5 and 6, the cover 24 is illustrated in greater detail. The cover 24 includes a body 62 of a size smaller than the channel 58, see FIG. 3, yet larger than the cutout 54. Particularly, the body 62 includes a rectangular planar top wall 64. In the illustrated embodiment of the invention, the top wall 64 is square. A side wall 66 extends about the entire perimeter of the top wall 64 and extends downwardly therefrom. A tubular collar 68 is connected to and depends downwardly from the top wall 64. The collar 68 is centrally located within the side wall 66. The height of the collar 68 is greater than the side wall 66. The collar 68 includes an inner cylindrical threaded wall 70. The threading is of a configuration selected according to the particular type of jar to be installed thereon. Particularly, a conventional storage jar includes a threaded neck, as is well known, which is threadably received in the tubular collar 68, as particularly illustrated in FIG. 1.

In the illustrated embodiment of the invention, the body 62 is of slightly less than 4.5 inch square and a height of approximately 0.50 inch to be slidably received in the channel 58, see FIG. 1. In the illustrated embodiment of the invention, the cover 24 is of injected molded plastic. The cover 24 is an integral one-piece unit.

Figure 10:
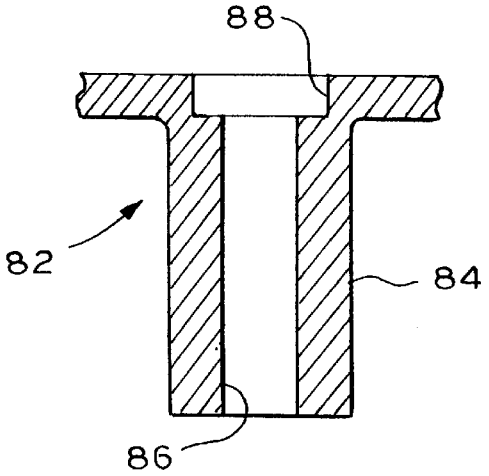
FIG. 10 is a sectional view taken along the line 10—10 of FIG. 9.

Referring to FIGS. 7–10, the bracket 34 is illustrated in greater detail. The bracket 34 is generally L-shaped and includes a top wall 72 and rear wall 74 connected at a right angle 76. An L-shaped side wall 78 is connected to the top wall 72 and rear wall 74 for providing suitable rigidity. A pair of bosses 80 extend downwardly from the top wall 72. A similar pair of bosses 82 extend frontwardly from the rear wall 74. One of the bosses 82 is shown in FIG. 10 and comprises a tubular body 84 having a through opening 86 connected to a counterbore 88. The spacing between the top wall bosses 80 corresponds to the spacing between the base bosses 82. The bracket 34 is of injection molded plastic. The bracket 34 comprises an integral one-piece unit.

Referring again to FIG. 1, the base 22 is adapted for versatile mounting applications. For example, the base 22 can be mounted to the underside of a horizontal wall 28 by inserting screws 88 upwardly through the openings 48 into the wall 28. Alternatively, the top wall 22 can be secured to the bracket 34 using screws 90 extending through the top wall openings 48 into the bracket top wall bosses 80. This can be done using nuts and bolts or using screws that thread directly into the plastic, as necessary or desired. The bracket 34 is then secured to a vertical support surface such as the wall 32 using screws 92 which pass through the bracket boss openings 86 into the wall 32.

The modular storage system as described has numerous potential uses such as for kitchen and bathroom storage, workshop or hobby storage, food storage or medical storage, or in recreational vehicles and trailers. As described, the base is attached to the bottom of a cabinet or the wall of a room so that the front facing channels 58 open toward the user. The cover 24 is mated with the channels 58 to be received therein, as illustrated in FIG. 1, with the body 62 bearing on the bottom wall bearing surface 60 surrounding the cutout 54. As a result, the collar 68 and a portion of the jar is disposed within and extends downwardly through the associated cutout 54. Although not shown, the cover 24 can be secured in place by a molded in detente (not shown).

As is apparent, the cover 24 could be a solid block with a threaded counterbore defining the tubular collar. In either case the collar is generally centered in the cutout 54 so that the jar is disposed within the cutout 54.

The rectangular cover 24 can be screwed onto a common plastic or glass jar and then slid into the storage unit. Since the lid can be screwed on while in the hand of the user, it does not require the more difficult process of aligning and rotating a jar into a fixed shelf on the wall. Alternatively, the jar 26 can be easily screwed into the cover 24 while the cover is installed in the shelf 22. Owing to the rectangular configuration of the cover mating in the rectangular channel 58, the cover 24 is prevented from turning while the jar is screwed in.

Owing to the plastic construction, all pieces are dishwasher safe and aseptic. Anything from food condiments to nuts or bolts can be stored. By using clear storage jars, the contents are readily visible. Virtually any commercial jar can be used with this design. Particularly, covers 24 can be provided with different size collars 68 and different threadings to adapt to the most widely available jars. Alternatively, jars can be provided with the storage system of appropriate size.

Thus, in accordance with the invention, a modular storage system is provided which includes easily removable rectangular covers. This simplifies removal for persons who might have difficulty grasping a circular cover, such as one with arthritic hands. The slide-out cover unit results in a construction in which the covers do not screw directly into the base. Further, the storage system when mounted to a vertical support system provides a storage shelf in which the base top wall 36 acts as a shelf for additional storage.

Thus, the invention broadly comprehends a modular storage system adapted for mounting to a support surface.

I claim:

1. A modular storage system adapted for mounting to a support surface, the system comprising:

a base including a planar top wall, connected to opposite downwardly depending side walls, and a bottom wall extending between the side walls, the bottom wall having a front opening cutout, the top, bottom and side walls together defining a front facing channel contiguous with the cutout; and a cover including a body of a size smaller than the channel yet larger than the cutout and a downwardly opening threaded collar affixed to and extending from the body for threadably mounting a storage jar, whereby the cover is removably receivable in the channel with the collar positioned at least partly above the cutout and the body bearing on the bottom wall with a jar mounted to the collar extending downwardly through the cutout.

2. The system of claim 1 wherein the base comprises a plastic base.

3. The system of claim 1 wherein the base is an integral one piece unit.

4. The system of claim 1 wherein the base includes openings through the top wall for receiving fasteners to secure the base to a horizontal support surface.

5. The system of claim 4 further comprising brackets mounted to the base, the brackets adapting the base for mounting to a vertical support surface.

6. The system of claim 1 wherein the cover body is of rectangular configuration corresponding to configuration of the channel.

7. The system of claim 1 wherein the cover comprises a plastic cover.

8. The system of claim 1 wherein the cover is an integral one piece unit.

9. A modular storage system adapted for mounting to a support surface, the system comprising:

a base including an elongate planar top wall, connected to a plurality of parallel, longitudinally spaced downwardly depending side walls, and a bottom wall parallel to the top wall and connected to bottoms of the side walls, the bottom wall having a front opening cutout between each pair of adjacent side walls, the top, bottom and side walls together defining a plurality of front facing channels each contiguous with one of the cutouts; and a plurality of covers, each cover including a body of a size smaller than each channel yet larger than each cutout and a downwardly opening threaded collar affixed to and extending from the body for threadably mounting a storage jar, whereby each cover is removably receivable in one of the channels with its collar positioned at least partly above the associated cutout and the body bearing on the bottom wall with a jar mounted to the collar extending downwardly through the associated cutout.

10. The system of claim 9 wherein the base comprises a plastic base.

11. The system of claim 9 wherein the base is an integral one piece unit.

12. The system of claim 9 wherein the base includes openings through the top wall for receiving fasteners to secure the base to a horizontal support surface.

13. The system of claim 12 further comprising brackets mounted to the base, the brackets adapting the base for mounting to a vertical support surface.

14. The system of claim 9 wherein the cover body is of rectangular configuration corresponding to configuration of the channel.

15. The system of claim 9 wherein the cover comprises a plastic cover.

16. The system of claim 9 wherein the cover is an integral one piece unit.

* * * * *